US006113714A

United States Patent [19]

Richard et al.

[11] Patent Number: 6,113,714

[45] Date of Patent: Sep. 5, 2000

[54] AMMONIUM NITRATE FUEL OIL BLASTING COMPOSITION HAVING IMPROVED WATER RESISTANCE

[75] Inventors: Andrew Richard, Acton; Earl Reckzin, North Bay, both of Canada

[73] Assignee: Eti Canada Inc., North Bay, Canada

[21] Appl. No.: 09/069,563

[22] Filed: Apr. 29, 1998

[51] Int. Cl.[7] ..... C06B 31/28; D03D 23/00

[52] U.S. Cl. ..... 149/46; 149/109.6; 149/112

[58] Field of Search ..... 149/46, 37, 17, 149/109.6, 112

[56] References Cited

U.S. PATENT DOCUMENTS

| | | | |
|---|---|---|---|
| Re. 33,788 | 1/1992 | Clay | 149/2 |
| 2,590,054 | 3/1952 | Taylor et al. | 52/19 |
| 2,703,528 | 3/1955 | Lee et al. | 102/23 |
| 2,992,912 | 7/1961 | Hradel et al. | 52/14 |
| 3,160,536 | 12/1964 | Aitchison | 149/8 |
| 3,279,965 | 10/1966 | Chatel de Raguet | 149/46 |
| 3,297,502 | 1/1967 | Chrisp | 149/6 |
| 3,368,929 | 2/1968 | Bell | 149/21 |
| 3,394,038 | 7/1968 | Minnick et al. | 149/21 |
| 3,640,784 | 2/1972 | Yancik et al. | 149/43 |
| 3,823,044 | 7/1974 | Cowan | 149/21 |
| 4,294,633 | 10/1981 | Clay | 149/2 |
| 4,474,629 | 10/1984 | York et al. | 149/109.6 |
| 4,475,965 | 10/1984 | York et al. | 149/21 |
| 4,619,721 | 10/1986 | Cescon et al. | 149/21 |
| 4,714,503 | 12/1987 | Cescon et al. | 149/21 |
| 4,736,683 | 4/1988 | Bachman et al. | 102/290 |
| 4,780,156 | 10/1988 | Sheeran et al. | 149/21 |
| 4,889,570 | 12/1989 | Leong | 149/7 |
| 4,933,029 | 6/1990 | Sheeran | 149/7 |
| 5,041,177 | 8/1991 | Hajto et al. | 149/5 |
| 5,480,500 | 1/1996 | Richard et al. | 149/46 |

FOREIGN PATENT DOCUMENTS

| | | |
|---|---|---|
| 1143267 | 2/1969 | United Kingdom . |

*Primary Examiner*—Charles T. Jordan
*Assistant Examiner*—Aileen J. Baker
*Attorney, Agent, or Firm*—Bereskin & Parr

[57] ABSTRACT

A water resistant blasting explosive comprises an organic carbonaceous fuel, an inorganic oxidizing salt, and particulate filler material, wherein prior to exposing the particulate filler material and the inorganic oxidizing salt to the organic carbonaceous fuel, from about 15 to about 60 wt % of the particulate filler material and the inorganic oxidizing salt are retained on a Tyler 10 sieve, from about 15 to about 60 wt % of the particulate filler material and the inorganic oxidizing salt are retained on a Tyler 14 sieve and from about 20 to about 60 wt % of the particulate filler material and the inorganic oxidizing salt are retained on a Tyler 20 sieve. The explosive is further characterized in that it is effectively free of gelling agents. The explosive has good water resistance and explosive energy.

38 Claims, No Drawings

AMMONIUM NITRATE FUEL OIL BLASTING COMPOSITION HAVING IMPROVED WATER RESISTANCE

FIELD OF THE INVENTION

This invention relates to the field of explosive compositions comprising organic carbonaceous fuel and an inorganic oxidizing salt. These compositions include ammonium nitrate and fuel oil (hereinafter referred to as "ANFO") blasting explosive compositions. This invention relates to an ANFO explosive composition having both good water resistance and good explosive characteristics.

BACKGROUND TO THE INVENTION

Explosive compositions comprising ammonium nitrate have been widely used throughout the world for many years. As ammonium nitrate is not readily detonatable in and of itself, it is typically mixed with carbonaceous fuels in order to obtain a mixture which is detonatable. Additional compounds such as sensitizers, densifiers, modifiers and surfactants may also be added to an ANFO explosive composition to improve various properties of the explosive composition including the sensitivity to detonation of the explosive, the energy of the explosion and the flowability of the explosive composition.

Typically, explosive compositions containing ammonium nitrate are manufactured at the location where they are to be utilized. For example, an ANFO explosive composition could be prepared at a mine and immediately loaded into a series of boreholes. The ANFO explosive composition would be loaded into the boreholes (typically from about 10 to 15 holes to more than about 100 holes) over a period of days. Typically, an ANFO explosive composition may be kept in a borehole anywhere from one hour up to fourteen days prior to being detonated. If the explosive is a prepackaged explosive composition, then due to shipping and handling time, the explosive composition must be stable for extended periods of time. A prepackaged explosive may also be stored for an extended period of time in a borehole prior to detonation. In some cases, the length of time between mixing the explosive composition and detonation of the explosive composition may be up to ninety days.

After being drilled, a borehole may remain dry for an extended period of time. However, in some cases, water will accumulate in boreholes, such as from the inflow of ground water. ANFO explosive compositions are adversely affected by water penetration and water absorption. Accordingly, if an ANFO explosive composition is loaded into a wet borehole or a borehole into which water subsequently seeps prior to detonation, then the ANFO explosive composition may deflagrate or, in fact, fail to detonate.

Typically, in order to increase resistance of the explosive composition to water, a gelling agent has been added to the explosive composition. The gelling agent may comprise guar gum, or guar gum and a mixture which includes, for example, sulphur and gilsonite (eg. ADTEC™) which is added to the ammonium nitrate.

Additionally, U.S. Pat. No. 5,480,500 (Richard et al) discloses an improved water resistant ANFO explosive, having a wide particle size distribution as well as a gelling agent as above described. The wide particle size distribution, together with the gelling agent, increases the resistance of the explosive composition to water. However, this patent teaches that the addition of a gelling agent such as guar gum is necessary to achieve a satisfactory water resistant product. The theory is that in the wide particle size distribution, the small particles (eg. miniprills) fill some of the interstitial spaces in the larger ammonium nitrate particles. The gelling agent swells or hydrates upon contact with water to form a gel. The gel acts as a barrier which reduces the absorption of water by the ammonium nitrate particles, thus increasing the overall water resistance of the explosive composition.

SUMMARY OF THE INVENTION

It has been surprisingly found by the present inventors that an explosive composition having a satisfactory water resistance level may be achieved by controlling only the particle size distribution of the inorganic oxidizing salt and the particulate filler material, without the addition of a gelling agent such as guar gum. More surprisingly, it has also been found that, after exposure to water, such an explosive composition may have a velocity of explosion greater than that of an explosive composition of Richard et al after being similarly exposed to water.

In accordance with the present invention, there is provided a blasting explosive comprising an organic carbonaceous fuel, an inorganic oxidizing salt, and particulate filler material, wherein prior to exposing the particulate filler material and the inorganic oxidizing salt to the organic carbonaceous fuel, from about 15 to about 60 wt % of the particulate filler material and the inorganic oxidizing salt are retained on a Tyler 10 sieve, from about 15 to about 60 wt % of the particulate filler material and the inorganic oxidizing salt are retained on a Tyler 14 sieve and from about 20 to about 60 wt % of the particulate filler material and the inorganic oxidizing salt are retained on a Tyler 20 sieve, the explosive containing less than 0.1 wt % of gelling agent based on the weight of the explosive composition.

The particulate filler material may have a different particle size distribution from the inorganic oxidizing salt. By using the forgoing parameters, the particle size distribution of the particulate filler material and the particle size distribution of the inorganic oxidizing salt are selected to increase the water resistance of the blasting explosive, without the addition of an effective amount of a gelling agent, and preferably, without the addition of any gelling agent. The particulate filler material may be incorporated into the blasting explosive by mixing the particulate filler material, inorganic oxidizing salt, and fuel oil together in any order.

The particulate filler material may be selected so as to enhance the explosive force of the explosive composition. For example, the particulate material may be an inorganic oxidizing salt, aluminum flakes, aluminum granules or a mixture thereof. Preferably, the filler material is ammonium nitrate and, most preferably, the particulate material comprises miniprills.

Preferably, the inorganic oxidizing salt comprises ammonium nitrate. The organic carbonaceous fuel is preferably fuel oil, such as No. 2 fuel oil.

It is preferred that the organic carbonaceous fuel is present in an amount from about 2 to about 10 wt % based upon the weight of the inorganic oxidizing salt and the fuel. More preferably, the organic carbonaceous fuel is present in an amount from about 4 to about 8 wt % and, most preferably, the ratio of inorganic oxidizing salt to organic carbonaceous fuel is about 94:6. The explosive composition when loaded into a borehole is a sensitized blend of inorganic oxidizing salt, and organic carbonaceous fuel.

The constituents of the particulate filler material preferably have a smaller particle size than the inorganic oxidizing salt particles. The particulate filler material will situate itself in interstitial spaces between the inorganic oxidizing salt particles. Accordingly, the particulate filler material decreases the voidage of the ammonium nitrate/particulate filler material mixture, thus increasing the water resistance of the explosive composition.

The particle size distribution of the particulate filler material and the inorganic oxidizing salt may be mutually selected to produce an explosive composition which is sensitized and has increased water resistance. Alternately, the particle size distribution, and the quantity of, the particulate filler material may be selected, in view of the characteristics of an ANFO explosive composition, to produce an explosive composition having increased water resistance. For example, in one embodiment, the explosive composition may be an ANFO explosive to which miniprills are added. The miniprills may be added to an existing ANFO explosive composition or, alternately, the miniprills may be added to the ammonium nitrate prior to the production of the ANFO explosive composition.

In one embodiment, the particulate filler material and the inorganic oxidizing salt are sized such that from about 25 to about 60 wt % of the particulate filler material and the inorganic oxidizing salt are retained on a Tyler 10 sieve, from about 15 to about 45 wt % of the particulate filler material and the inorganic oxidizing salt are retained on a Tyler 14 sieve and from about 20 to about 40 wt % of the particulate filler material and the inorganic oxidizing salt are retained on a Tyler 20 sieve.

In another embodiment, the particulate filler material and the inorganic oxidizing salt are sized such that from about 35 to about 50 wt % of the particulate filler material and the inorganic oxidizing salt are retained on a Tyler 10 sieve, from about 20 to about 40 wt % of the particulate filler material and the inorganic oxidizing salt are retained on a Tyler 14 sieve and from about 20 to about 40 wt % of the particulate filler material and the inorganic oxidizing salt are retained on a Tyler 20 sieve.

The ANFO explosive composition may comprise from about 5 to about 50% miniprills, more preferably from about 5 to about 30% miniprills and, most preferably about 30% miniprills, based upon the weight of the ammonium nitrate. This produces an explosive composition having a wider particle size distribution and a decreased voidage.

In another embodiment, instead of adding a particulate filler material such as miniprills to the ammonium nitrate, ammonium nitrate may be passed through a plurality of sieves to provide ammonium nitrate for incorporation into an ANFO explosive composition wherein the particle size distribution of the ammonium nitrate has been selected to increase the water resistance of the blasting explosive.

In a further embodiment, the prill manufacturing process, eg. the operating parameters of the prilling tower, may be adjusted to produce ammonium nitrate having a particle size distribution which is selected to increase the water resistance of the blasting explosive.

According to these latter two embodiments, a blasting explosive comprises an organic carbonaceous fuel and an inorganic oxidizing salt, wherein prior to exposing said inorganic oxidizing salt to the organic carbonaceous fuel, from about 15 to about 60 wt % of the inorganic oxidizing salt is retained on a Tyler 10 sieve, from about 15 to about 60 wt % of the inorganic oxidizing salt is retained on a Tyler 14 sieve and from about 20 to about 60 wt % of the inorganic oxidizing salt is retained on a Tyler 20 sieve.

In a further embodiment, there is provided a method of increasing the water resistance of a blasting explosive comprising an organic carbonaceous fuel, an inorganic oxidizing salt and less than 0.1 wt % of gelling agent based on the weight of the explosive composition. The method comprises the step of incorporating particulate filler material as part of the blasting explosive, the particle size distribution of the particulate filler material sized to fill a portion of the interstitial spaces between the inorganic oxidizing salt particles to increase the water resistance of the blasting explosive.

The method may comprise the steps of mixing the inorganic oxidizing salt and the particulate filler material to produce a first mixture and mixing the first mixture with the organic carbonaceous fuel to form the blasting explosive. Alternately, the method may comprises the steps of producing a sensitized blasting explosive comprising a mixture of the inorganic oxidizing salt and the organic carbonaceous fuel; and, mixing this blasting explosive with the particulate filler material to produce the blasting explosive having improved water resistance.

In a further embodiment, there is provided a method of increasing the water resistance of a blasting explosive comprising an organic carbonaceous fuel, an inorganic oxidizing salt and less than 0.1 wt % of gelling agent based on the weight of the explosive composition. The method comprises selecting an inorganic oxidizing salt to reduce the voidage in the blasting explosive and to increase the water resistance of the blasting explosive. The method may comprise the steps of mixing together at least two sets of inorganic oxidizing salt particles, each of the sets having a different particle size distribution, to produce the inorganic oxidizing salt having a particular particle size distribution.

DESCRIPTION OF THE PREFERRED EMBODIMENT

The explosive composition of the present invention comprises an explosive mixture of organic carbonaceous fuel and inorganic oxidizing salts, which is substantially free of gelling agents.

The organic carbonaceous fuel may be selected from any fuel known in the art. The fuel may be a solid (e.g. a wax) or a liquid (e.g. fuel oil, heating oil, diesel fuel, jet fuel, kerosene, mineral oils, saturated fatty acids such as lauric acid and stearic acid, alcohols such as cetyl alcohol, corn oil, soy bean oil and the like) or a mixture of solid and liquid fuels. Such fuels may also be supplemented with fuel-soluble ingredients such as glucose, mannose, fructose, waxes, such as microcrystalline wax, paraffin wax, petroleum wax and the like. Preferably, the organic carbonaceous fuel comprises fuel oil, such as No. 2 fuel oil.

The inorganic oxidizing salt may comprise ammonium nitrate. The ammonium nitrate is in the form of separate discrete particles, such as prills, granules, pellets and/or fines as opposed to cast or powdered ammonium nitrate or solutions thereof. Particulate ammonium nitrate suitable in ANFO blasting explosive compositions are known in the art.

The size of the ammonium nitrate particles may be sufficiently small to pass through a 6 Tyler™ sieve but sufficiently large so that most particles are retained on a 35 Tyler sieve. Typically, ammonium nitrate used in explosive compositions comprises particles wherein about 95% or more pass through a Tyler 6 sieve but are retained on a 35 Tyler™ sieve. Typically, such prills have a particle density of from about 1.35 g/cc to about 1.5 g/cc and a poured density of 0.7 g/cc to 0.85 g/cc, preferably from about 0.75 g/cc to about 0.85 g/cc. In the trade, such porous ammonium nitrate particles are known as prilled ammonium nitrate.

A portion of the ammonium nitrate component may be replaced by other inorganic oxidizer salts known in the art including alkali metal nitrates and perchlorates (such as sodium nitrate and potassium nitrate) or alkaline-earth metal nitrates and perchlorates (such as calcium nitrate, magnesium nitrate and barium nitrate). These additional components may be added in an amount from about 0 to about 20 wt % and, more preferably from about 0 to about 15 wt % based upon the weight of the ammonium nitrate particles.

It is preferred that the organic carbonaceous fuel is present in an amount from about 2 to about 10 wt % based upon the weight of the carbonaceous fuel and inorganic oxidizing salts. More preferably, the organic carbonaceous fuel is present in an amount from about 4 to about 8 wt % and, most preferably, the ratio of inorganic oxidizing salts to carbonaceous fuel is about 94:6.

The explosive composition of the present invention contains sufficient organic carbonaceous fuel so that the explosive composition is essentially oxygen balanced, taking into consideration the total oxidizing salts, fuel, sensitizers and other additives present in the explosive. Preferably the blend has an oxygen balance more positive than about −25% and, more preferably, in the range of about −10 to +10%.

It was previously believed that in order to prepare an ANFO explosive composition having a satisfactory water resistance, it was necessary to add a gelling agent to the explosive composition. The theory was that the gelling agent present would swell or hydrate upon contact with water, forming a gell. The gell would then act as a barrier which reduces or prevents the absorption of water by the inorganic oxidizing salt particles. Although the previously mentioned U.S. Pat. No. 5,480,500 discloses that the water resistance of an ANFO explosive composition may be improved by providing a wide particle size distribution, the inventors in that patent still believed that in order to satisfactorily increase water resistance, it was necessary to add a gelling agent such as guar gum to the ANFO composition. This was particularly so since a preferred embodiment of Richard et al was the use of mini-prills which are relatively small particles and, due to their relatively high surface area, are particularly soluble.

However, the present inventors have surprisingly discovered that, in many instances, the gelling agent may be omitted, while still providing a good or adequate water resistance. The addition of a gelling agent such as guar gum, while an organic compound, desensitizes the explosive composition and thus significantly reduces the velocity (and therefore the force) of the ANFO composition when detonated. It was expected that by removing the guar gum, the explosive composition would be susceptible to water damage and that the explosive composition may deflagrate. Unexpectedly, by omitting the gelling agent, the amount of energy available upon detonation is significantly increased. After similar exposure to water, a higher energy explosion may be obtained by omitting the gelling agent from the explosive composition of this invention as compared to the explosive composition of Richard et al. Further, a higher energy explosion may be obtained compared with the energy typical for standard ANFO explosive compositions not having a wide particle distribution, while still providing an increased water resistance over such prior ANFO explosive compositions which do not contain a gelling agent.

The gelling agent will be present in an amount less than about 0.1 wt. % based upon the weight of the explosive composition and, preferably, the explosive composition with contain no gelling agent.

In one embodiment, the explosive composition further includes particulate filler material. The particulate filler material may be any compound which would not have a deleterious effect on the explosive composition. Accordingly, the particulate filler material may be an inert substance which produces a neutral effect on the force of the explosion on detonation of the explosive composition. Alternately, the particulate filler material may be an active ingredient which would act as a fuel increasing the force of the explosive composition. Accordingly, the particulate filler material preferably comprises an inorganic oxidizing salt, aluminum flake, granular aluminum or mixtures thereof and, most preferably, ammonium nitrate.

The particulate filler material is sized to fill at least a portion of the interstitial spaces between the inorganic oxidizing salt particles. If too high a percentage of the interstitial spaces are filled, then the sensitivity of the explosive composition is reduced. Generally, the particle size of typical ammonium nitrate prills which are utilized to manufacture ANFO explosive compositions have a prill size between Tyler 6 and 35, with over 90 wt % of the prills being retained on a sieve size of Tyler 10 or 14. Accordingly, the particle size of a substantial portion of the particulate filler material preferably passes through Tyler 14 sieve. For example more than about 50 wt % of the particulate filler material may be retained on Tyler sieve sizes 20, 28 or less, preferably more than about 70 wt % and most preferably about 80–90 wt %. Accordingly, the particle size distribution of the ammonium nitrate and the particulate filler material may be bimodal.

By combining the particulate filler material and the ammonium nitrate prills, the solid particles of the explosive composition (namely the ammonium nitrate and the particulate filler material) may comprise from about 15 to about 60 wt % particles which are retained on a Tyler 10 sieve, from about 15 to about 60 wt % particles which are retained on a Tyler 14 sieve and from about 20 to about 60 wt % particles which are retained on a Tyler 20 sieve. Preferably, from about 25 to about 60 wt % of the particles are retained on a Tyler 10 sieve, from about 15 to about 45 wt % of the particles are retained on a Tyler 14 sieve and from about 20 to about 40 wt % of the particles are retained on a Tyler 20 sieve. Most preferably, from about 35 to about 50 wt % of the particles are retained on a Tyler 10 sieve, from about 20 to about 40 wt % of the particles are retained on a Tyler 14 sieve and from about 20 to about 40 wt % of the particles are retained on a Tyler 20 sieve.

As discussed above, the average particle size of the filler material is generally less than the average particle size of the inorganic oxidizing salt. The ratio of average particle size of the particulate filler material to the inorganic oxidizing salt may be from about 0.3:1 to about 0.8:1 and, preferably from about 0.5:1 to about 0.6:1. At this level, at least some of the particulate filler material fits within the interstitial spaces of the inorganic oxidizing salt particles and accordingly decreases the voidage thereof.

A particularly preferred particulate filler material comprises miniprills. Miniprills are particulate ammonium nitrate particles wherein, generally, at least about 95 wt % of the particles pass through a 12 Tyler screen mesh size and at least about 95% of the particles are retained on a 28 Tyler screen mesh. The particle size of at least 95% of the ammonium nitrate miniprills will preferably range from about 0.4 mm to about 2.4 mm and, more preferably, from about 0.6 mm to about 1.4 mm. Miniprills typically have a high density which may range from about 0.85 to about 1.05 g/cc, preferably, from about 0.90 to about 1.0 g/cc, and most preferably, about 0.95 g/cc, as determined by weighing an untapped sample of the prills in a container of known volume. Miniprills may be prepared by conventional means, such as spraying molten ammonium nitrate containing very little moisture (e.g 0.1 to 0.4 wt % water and preferably less than 0.2 wt % water) at elevated temperature (e.g. 175° C. or higher) into a prilling tower countercurrent to cooling air which solidifies the droplets into prills which are ultimately cooled to ambient temperature. This results in the production of miniprills which are generally round.

The explosive composition may comprise from about 5 to about 50% miniprills, more preferably from about 5 to about 30% miniprills and, most preferably about 30% miniprills, based upon a weight of the ammonium nitrate.

The ability of the particulate filler material to fill the interstitial spaces of the inorganic oxidizing salt is enhanced if the shape of the inorganic oxidizing salt particles and the particulate filler material are complimentary. For example, if the inorganic oxidizing salt particles are generally round in shape (e.g. ammonium nitrate prills), then the use of particulate filler material which is generally round in shape, such as miniprills prepared in a prilling tower, is preferably utilized. It will be appreciated that if the inorganic oxidizing salt particles are of a different shape, then the complimentary shape of the particulate filler material will vary.

The particulate filler material may be incorporated into the blasting explosive by mixing the particulate filler material, inorganic oxidizing salt, and fuel oil together in any order. The particulate filler material is preferably mixed with the inorganic oxidizing salt. The mixture of ammonium nitrate and particulate filler material may then be mixed with the fuel oil to produce a sensitized blasting explosive composition of the instant invention. Alternately, the inorganic oxidizing salt and the fuel oil may be mixed in any manner known in the art to produce a sensitized blasting explosive and the particulate filler material may then be added to the blasting explosive to produce the blasting explosive of the instant invention having improved water resistance. Alternately, the particulate filler material may be added at an intermediate stage.

The forgoing discussion has been premised upon the assumption that the particulate filler material is selected based upon the analysis of the shape and size of an existing supply of inorganic oxidizing salt particles. This may particularly be the case, for example, where a manufacturer of explosive compositions had an existing inventory of ammonium nitrate particles but intends to produce and ANFO requiring enhanced water resistance. In such a case, the manufacturer may accordingly locate a source of particulate filler material, e.g. miniprills, having the desired shape and size distribution to produce an explosive composition according to the instant invention having improved water resistance.

Alternately, for example if the manufacturer does not have an inventory of ammonium nitrate, an explosive composition according to the instant invention may be prepared by mutually selecting the size and shape of the inorganic oxidizing salt particles and the filler material.

It will also be appreciated that an appropriate size distribution of ammonium nitrate particles may be prepared, not by mixing ammonium nitrate and particulate filler material together, but by producing ammonium nitrate particles having a particle size distribution such as that which would be obtained by mixing together ammonium nitrate particles and miniprills. Thus ammonium nitrate having a decreased voidage would be directly produced. This may be achieved by screening ammonium nitrate particles to produce particles having a particle size distribution similar to that which is achieved by mixing conventional ammonium nitrate particles and miniprills.

In a further embodiment, the prill manufacturing process, eg. the operating parameters of the prilling tower, may be adjusted to produce ammonium nitrate having a particle size distribution which is selected to increase the water resistance of the blasting explosive (e.g. particles having a particle size distribution similar to that which is achieved by mixing conventional ammonium nitrate particles and miniprills).

The invention will be further understood by the following examples which are not to be construed as a limitation on the invention. Those skilled in the art will appreciate that other and further embodiments are obvious and within the spirit and scope of this invention from the teachings of the present examples taken with the accompanying specifications.

EXAMPLE 1

The water resistance of ANFO explosive compositions prepared in accordance with the present invention was compared with (1) "standard" ANFO explosive compositions not containing the particle distribution described herein, and (2) ANFO explosive compositions containing 30% miniprills and a guar gum gelling agent. The different explosive compositions which were prepared are set out in the Table 1 below.

The water resistance of the these explosive compositions was measured according to the following procedure. The required density of the explosive composition was first selected. A sufficient weight of ANFO explosive composition was then placed into a 1,000 ml graduated cylinder. The cylinder was gently tapped until the contents were level with the 1,000 ml mark.

100 ml of cold tap water was poured into the centre area of the ANFO explosive composition in the 1,000 ml graduated cylinder. The water was gently poured over the top of the ANFO explosive composition for a period of about 15 seconds. The ANFO explosive composition and water was then allowed to stand for one hour. At the end of the hour, the deepest penetration of the liquid in the 1,000 ml graduated cylinder was measured. The results are set out in Table 1.

TABLE 1

| | DEPTH OF WATER PENETRATION (cm) | |
|---|---|---|
| EXPLOSIVE MIXTURE | SAMPLE A | SAMPLE B |
| 94% NITROCHEM PRILLS/6% FUEL OIL | 28 | 30 |
| 30% MINIPRILLS & NITROCHEM PRILLS | | |
| +5% GUAR GUM | 8 | 11 |
| +7% GUAR GUM | 7.5 | 9.0 |
| 40% MINIPRILLS & NITROCHEM PRILLS +7% GUAR GUM | 7 | 9 |
| 30% MINIPRILLS & NITROCHEM PRILLS NO GUAR GUM | 14 | 16.6 |
| 40% MINIPRILLS & NITROCHEM PRILLS NO GUAR GUM | 15 | 16 |

As can be seen, the explosive composition prepared according to the present invention showed a significantly reduced water resistance compared with explosive compositions containing guar gum. In fact, the explosive composition of this invention absorbed about twice as much water as the explosive composition of Richard et al. The explosive composition did demonstrate an improved water absorption compared with the explosive composition not containing miniprills (reduced between 44% and 50%).

EXAMPLE 2

The explosive energy of explosive compositions prepared in accordance with the present invention (containing 30% miniprills) was compared with a similar explosive composition according to Richard et al which also contained 7% guar gum. The conditions and results are set out in Table 2.

TABLE 2

| PRODUCT | DENSITY (g/cc) (tapped density in 3"–6" diameter tubes) | ENERGY WEFF (RBS) | BRISANCE (RBS) SOFT | MEDIUM | HARD |
|---|---|---|---|---|---|
| 30% miniprills (with 7% guar gum) | 0.95–0.98 | 106 | 131 | 140 | 144 |
| 30% miniprills (without guar gum) | 0.97–1.00 | 116 | 148 | 159 | 164 |

As can be seen, in all cases, the explosive energy of the product without the addition of guar gum was higher than the explosive energy of the product including guar gum.

EXAMPLE 3

Additional tests were conducted to compare the velocity on detonation of explosive compositions prepared in accordance with the present invention (containing 30% miniprills) with similar compositions (also containing 30% miniprills) of Richard et al which also contained 5.5% guar gum and explosive compositions containing all miniprills and no guar gum. All of the ANFO explosive compositions contained 6% fuel oil and 94% ammonium nitrate. The test conditions and results are set out in Table 3.

TABLE 3

| Test | Conditions | VELOCITY ON DETONATION (mps) 30% miniprills no guar gum) Density = 0.94 g/cc) | 30% miniprills with 5.5% guar gum | all miniprills no guar gum density = 1.04 g/cc |
|---|---|---|---|---|
| 1 | 2" sch. 40 steel ½ lb. primer | 3735–3735 | 3175–3342 (density = 0.91 g/cc) | 3735–3735 |
| 2 | 2" sch. 40 steel 90 g primer | 3528–3256 | 3342–3342 (density = 0.94 g/cc) | N/A |
| 3 | 2" sch. 40 steel ½ lb. primer | N/A | 3175–3175 (0.95 g/cc) | N/A |
| 4 | 1 ½" sch. 40 steel ½ lb. primer | 3528–3174 | N/A | Failure |
| 5 | 1 ½" sch. 40 steel 90 g primer | 3024–2886 | 2886–2886 | Failure |

Tests were also conducted in 3" diameter bore holes, to compare the velocity or detonation of the different explosive compositions. The conditions and test results are set out in Table 4 below.

TABLE 4

| COMPOSITION | DENSITY (g/cc) | PRIMER | VOD (mps) |
|---|---|---|---|
| 30% miniprills (no guar gum) | 0.94 | 1 lb. cast | 3735 |
| 30% miniprills (5.5% guar gum) | 0.95 | 2 × 8 Boostrite | 3300 |
| all miniprills | 1.05 | 1 lb. cast | 3900 |

As can been seen from the above test results, the explosive composition of the instant invention containing 30% miniprills without guar gum consistently showed a higher velocity on detonation than the composition of Richard et al which contained guar gum. Further, where data was available, the explosive energy of the compositions prepared according to the present invention was comparable to the explosive energy of "standard" ANFO compositions (all miniprills).

Accordingly, it will be appreciated that the present invention provides an ANFO explosive composition with good water resistance and explosive characteristics.

What is claimed is:

1. A water resistant blasting explosive comprising an organic carbonaceous fuel, an inorganic oxidizing salt, and particulate filler material, wherein prior to exposing said particulate filler material and said inorganic oxidizing salt to said organic carbonaceous fuel, from about 15 to about 60 wt % of said particulate filler material and said inorganic oxidizing salt are retained on a Tyler 10 sieve, from about 15 to about 60 wt % of said particulate filler material and said inorganic oxidizing salt are retained on a Tyler 14 sieve and from about 20 to about 60 wt % of said particulate filler material and said inorganic oxidizing salt are retained on a Tyler 20 sieve, said explosive being free of gelling agent.

2. The blasting explosive as claimed in claim 1 wherein from about 25 to about 60 wt % of said particulate filler material and said inorganic oxidizing salt are retained on a Tyler 10 sieve, from about 15 to about 45 wt % of said particulate filler material and said inorganic oxidizing salt are retained on a Tyler 14 sieve and from about 20 to about 40 wt % of said particulate filler material and said inorganic oxidizing salt are retained on a Tyler 20 sieve.

3. The blasting explosive as claimed in claim 1 wherein from about 35 to about 50 wt % of said particulate filler material and said inorganic oxidizing salt are retained on a Tyler 10 sieve, from about 20 to about 40 wt % of said particulate filler material and said inorganic oxidizing salt are retained on a Tyler 14 sieve and from about 20 to about 40 wt % of said particulate filler material and said inorganic oxidizing salt are retained on a Tyler 20 sieve.

4. The blasting explosive as claimed in claim 1 wherein said particulate filler material comprises a member selected from the group consisting of an inorganic oxidizing salt, aluminum and mixtures hereof.

5. The blasting explosive as claimed in claim 1 wherein said articulate filler material comprises ammonium nitrate.

6. The blasting explosive as claimed in claim 1 wherein said articulate filler material comprises miniprills.

7. The blasting explosive as claimed in claim 6 wherein said inorganic oxidizing salt comprises ammonium nitrate and said organic carbonaceous fuel comprises fuel oil.

8. The blasting explosive as claimed in claim 7 wherein said explosive composition comprises from about 5 to about 50% miniprills.

9. The blasting explosive as claimed in claim 8 wherein said explosive composition comprises about 5 to about 30% miniprills.

10. The blasting explosive as claimed in claim 1 wherein the ratio of the average particle size of the particulate filler material to the average particle size of the inorganic oxidizing salt is from about 0.3:1 to about 0.8:1.

11. The blasting explosive as claimed in claim 8 wherein the ratio of the average particle size of the particulate filler material to the average particle size of the inorganic oxidizing salt is from about 0.5:1 to about 0.6:1.

12. A blasting explosive comprising fuel oil, ammonium nitrate, and particulate filler material, said explosive being free of gelling agent, wherein prior to exposing said particulate filler material and said ammonium nitrate to said fuel oil, from about 15 to about 60 wt % of said particulate filler material and said ammonium nitrate are retained on a Tyler 10 sieve, from about 15 to about 60 wt % of said particulate filler material and said ammonium nitrate are retained on a Tyler 14 sieve and from about 20 to about 60 wt % of said particulate filler material and said ammonium nitrate are retained on a Tyler 20 sieve.

13. The blasting explosive as claimed in claim 12 wherein from about 25 to about 60 wt % of said particulate filler material and said ammonium nitrate are retained on a Tyler 10 sieve, from about 15 to about 45 wt % of said particulate filler material and said ammonium nitrate are retained on a Tyler 14 sieve and from about 20 to about 40 wt % of said particulate filler material and said ammonium nitrate are retained on a Tyler 20 sieve.

14. The blasting explosive as claimed in claim 12 wherein from about 35 to about 50 wt % of said particulate filler material and said ammonium nitrate are retained on a Tyler 10 sieve, from about 20 to about 40 wt % of said particulate filler material and said ammonium nitrate are retained on a Tyler 14 sieve and from about 20 to about 40 wt % of said particulate filler material and said ammonium nitrate are retained on a Tyler 20 sieve.

15. The blasting explosive as claimed in claim 12 wherein said particulate filler material comprises a member selected from the group consisting of an ammonium nitrate, aluminum and mixtures thereof.

16. The blasting explosive as claimed in claim 12 wherein said particulate filler material comprises ammonium nitrate.

17. The blasting explosive as claimed in claim 12 wherein said particulate filler material comprises miniprills.

18. The blasting explosive as claimed in claim 17 wherein said explosive composition comprises from about 5 to about 50% miniprills.

19. The blasting explosive as claimed in claim 18 wherein said explosive composition comprises from about 5 to about 30% miniprills.

20. The blasting explosive as claimed in claim 13 wherein said particulate filler material comprises ammonium nitrate.

21. The blasting explosive as claimed in claim 13 wherein said particulate filler material comprises miniprills.

22. A method of increasing the water resistance of a blasting explosive comprising an organic carbonaceous fuel, and an inorganic oxidizing salt, said blasting explosive being free of gelling agent, said method comprising the step of incorporating particulate filler material as part of said blasting explosive, the particle size distribution of said particulate filler material sized to fill a portion of the interstitial spaces between the inorganic oxidizing salt particles to increase the water resistance of the blasting explosive.

23. The method as claimed in claim 22 wherein said method comprises the steps of:

(a) mixing said inorganic oxidizing salt and said particulate filler material to produce a first mixture;

(b) mixing said first mixture with said organic carbonaceous fuel to form said blasting explosive.

24. The method as claimed in claim 22 wherein said method comprises the steps of:

(a) producing a sensitized blasting explosive comprising a mixture of said inorganic oxidizing salt and said organic carbonaceous fuel; and, (b) mixing the blasting explosive of step (a) with said particulate filler material to produce said blasting explosive having improved water resistance.

25. The method as claimed in claim 22 wherein said particulate filler material comprises an inorganic oxidizing salt.

26. The method as claimed in claim 22 wherein said particulate filler material comprises ammonium nitrate.

27. The method as claimed in claim 22 wherein said particulate filler material comprises miniprills.

28. The method as claimed in claim 27 wherein said inorganic oxidizing salt comprises ammonium nitrate and said organic carbonaceous fuel comprises fuel oil.

29. The method as claimed in claim 22 wherein the ratio of the average particle size of the particulate filler material to the average particle size of the inorganic oxidizing salt is from about 0.3 to about 0.8.

30. The method as claimed in claim 22 wherein the ratio of the average particle size of the particulate filler material to the average particle size of the organic oxidizing salt is from about 0.5 to about 0.6.

31. A method of increasing the water resistance of a blasting explosive comprising an organic carbonaceous fuel, and an inorganic oxidizing salt, the blasting explosive being free of gelling agent, said method comprising selecting an inorganic oxidizing salt to reduce the voidage in the blasting explosive and to increase the water resistance of the blasting explosive.

32. The method as claimed in claim 31 further comprising the step of mixing together at least two sets of inorganic oxidizing salt particles, each of said sets having a different particle size distribution, to produce said inorganic oxidizing salt having a particular particle size distribution.

33. The method as claimed in claim 32 wherein said inorganic oxidizing salt comprises ammonium nitrate and said organic carbonaceous fuel comprises fuel oil.

34. The method as claimed in claim 33 wherein at least one of said sets of inorganic oxidizing salt particles comprises ammonium nitrate miniprills.

35. The method as claimed in claim 34 wherein the blasting explosive comprises two sets of inorganic oxidizing salt particles and the ratio of the average particle size of one of said sets of inorganic oxidizing salt particles to the average particle size of the other of said sets of inorganic oxidizing salt particles is from about 0.3 to about 0.8.

36. The method as claimed in claim 31 wherein the blasting explosive comprises two sets of inorganic oxidizing salt particles and the ratio of the average particle size of one of said sets of inorganic oxidizing salt particles to the average particle size of the other of said sets of inorganic oxidizing salt particles is from about 0.5 to about 0.6.

37. In a method of producing a blasting explosive comprising manufacturing an inorganic oxidizing salt having a particular particle size distribution and mixing said inorganic oxidizing salt with an organic carbonaceous fuel, the blasting explosive being free of gelling agent, to produce said blasting explosive, the step of adjusting the particle size distribution of said inorganic oxidizing salt produced by said manufacturing step to reduce the voidage in the blasting explosive to produce a blasting explosive having improved water resistance.

38. The method as claimed in claim 37 wherein said inorganic oxidizing salt comprises ammonium nitrate, and said organic carbonaceous fuel comprises fuel oil.

* * * * *